US012312982B1

(12) United States Patent
McKee, Jr.

(10) Patent No.: US 12,312,982 B1
(45) Date of Patent: May 27, 2025

(54) VALVE FOR AN OVERHEAD CAM ENGINE AND AN OVERHEAD CAM ENGINE ASSEMBLY

(71) Applicant: James McKee, Jr., Crossville, TN (US)

(72) Inventor: James McKee, Jr., Crossville, TN (US)

( * ) Notice: Subject to any disclaimer, the term of this patent is extended or adjusted under 35 U.S.C. 154(b) by 0 days.

(21) Appl. No.: 18/909,436

(22) Filed: Oct. 8, 2024

(51) Int. Cl.

| | |
|---|---|
| ***F01L 5/04*** | (2006.01) |
| ***F01L 1/053*** | (2006.01) |
| ***F01L 1/46*** | (2006.01) |
| ***F01L 3/10*** | (2006.01) |
| ***F01L 3/20*** | (2006.01) |
| *F01L 1/08* | (2006.01) |
| *F01L 3/00* | (2006.01) |
| *F01L 3/14* | (2006.01) |

(52) U.S. Cl.
CPC ..... *F01L 5/04* (2013.01); *F01L 1/0532* (2013.01); *F01L 1/462* (2013.01); *F01L 3/10* (2013.01); *F01L 3/20* (2013.01); *F01L 2001/0535* (2013.01); *F01L 1/08* (2013.01); *F01L 3/14* (2013.01); *F01L 2003/258* (2013.01)

(58) Field of Classification Search
CPC . F01L 1/0532; F01L 1/08; F01L 1/462; F01L 3/10; F01L 3/14; F01L 3/20; F01L 2003/258; F01L 5/04
USPC ..... 123/90.27, 90.34, 90.6, 90.67
See application file for complete search history.

(56) References Cited

U.S. PATENT DOCUMENTS

| | | | | | |
|---|---|---|---|---|---|
| 1,009,599 | A * | 11/1911 | Teetor | F01L 5/04 | 123/188.4 |
| 1,156,309 | A * | 10/1915 | Phifer | F01L 5/04 | 123/188.4 |
| 1,261,207 | A * | 4/1918 | Bente | F01L 5/04 | 123/58.9 |
| 1,405,747 | A * | 2/1922 | Booth | F01L 5/04 | 123/73 V |
| 1,504,093 | A * | 8/1924 | Burtnett | F01L 5/04 | 123/315 |
| 5,636,602 | A | 6/1997 | Meister | | |
| 7,377,249 | B1 | 5/2008 | Dingle | | |
| 8,607,763 | B2 | 12/2013 | Gonigman | | |
| 9,181,821 | B2 | 11/2015 | Meldolesi | | |
| D753,186 | S | 4/2016 | Dopke | | |
| 2013/0298889 | A1 | 11/2013 | Phillips | | |

FOREIGN PATENT DOCUMENTS

| | | |
|---|---|---|
| GB | 2212857 | 8/1989 |

* cited by examiner

*Primary Examiner* — Jorge L Leon, Jr.

(57) ABSTRACT

A valve for an overhead cam engine includes a valve sleeve, a valve cylinder, and a valve spring. The valve sleeve is cylindrical and has an annular shoulder and ports designed to permit flow of fuel and gases into and out of an internal combustion chamber. The valve cylinder includes a cylindrical body and a top cap. The top cap includes a contact surface to be engaged by a cam lobe and an annular projection. The valve spring is positioned about the cylindrical body and between the annular projection and the annular shoulder. The valve spring is designed to expand and move the valve cylinder partially out of the valve sleeve to unblock the ports and open the valve. The valve spring is designed to be compressed to permit the cam lobe to move the valve cylinder into the valve sleeve to block the ports and close the valve.

15 Claims, 5 Drawing Sheets

VALVE FOR AN OVERHEAD CAM ENGINE AND AN OVERHEAD CAM ENGINE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to valves for internal combustion engines for vehicles and more particularly pertains to a new valve with greater durability and tuning capabilities. Presently, internal combustion engines, which will be referred to herein as "engines" for convenience, are the primary type of engine used in motorized vehicles. As is well known, these engines use valves to control flow of fuel and gases, such as air and combustion gases. The flow is controlled by the opening and closing of poppet valves. Poppet valves are also known as mushroom valves due to their design, which consists of a slender stem and a round head at the end of the stem. Due to their small size, poppet valves can be prone to failure from wear and tear and suffer from poor heat dissipation. In addition, poppet valves project into the combustion chamber, so failure of the poppet valve can result in pieces entering the engine itself and causing additional and potentially catastrophic damage to the engine itself. Finally, poppet valves are spring-loaded into a sealed position to close a passage, and pressed by a cam against the spring force to open the passage. This spring force can weaken over time, causing a weak or compromised seal, which is undesirable. The present invention proposes a valve that deviates from the traditional poppet valve design to overcome these disadvantages. The inventive valve has a cylindrical design that is more robust and durable, does not project into the combustion chamber, and uses the cams to press the valve into a sealing position to maintain a consistent and durable seal.

(2) Description of Related Art Including Information Disclosed Under 37 CFR 1.97 and 1.98

The prior art relates to valves for internal combustion engines for vehicles that utilize poppet valves. The prior art, as best understood, does not disclose a valve for an overhead cam engine includes a valve sleeve, a valve cylinder, and a valve spring, wherein the valve sleeve and valve cylinder have a cylindrical shape, and wherein the valve spring is designed to expand and move the valve cylinder partially out of the valve sleeve to unblock the ports and open the valve, and the valve spring is designed to be compressed to permit a cam lobe to move the valve cylinder into the valve sleeve to block the ports and close the valve.

BRIEF SUMMARY OF THE INVENTION

An embodiment of the disclosure meets the needs presented above in a valve for an overhead cam engine generally comprising a valve sleeve, a valve cylinder, and a valve spring. The valve sleeve is cylindrical. The valve sleeve includes a top portion and a bottom portion. The top portion includes an annular shoulder. The bottom portion includes ports designed to permit flow of fuel and gases into and out of an internal combustion chamber through the valve sleeve. The valve cylinder is positioned in the valve sleeve. The valve cylinder includes a cylindrical body and a top cap. The top cap includes a contact surface that is designed to be engaged by a cam lobe. The top cap includes an annular projection extending outwardly beyond an outer surface of the cylindrical body. The valve spring is positioned about the cylindrical body of the valve cylinder. The valve spring is positioned between the annular projection of the valve cylinder and the annular shoulder of the valve sleeve. The valve spring is designed to expand and move the valve cylinder partially out of the valve sleeve to unblock the ports and open the valve. The valve spring is designed to be compressed to permit the cam lobe to move the valve cylinder into the valve sleeve to block the ports and close the valve.

Another embodiment of the disclosure is an overhead cam engine assembly that includes a plurality of the valves. A camshaft is designed to be rotatably mounted in the internal combustion engine. The camshaft includes a shaft portion and a plurality of cam lobes projecting from the shaft portion. Each of the cam lobes is designed to continuously contact the contact surface of the valve cylinder of a respective one of the plurality of valves. Each of the cam lobes includes a cam nose and a cam flank. The cam nose is designed to axially displace the valve cylinder of a respective one of the plurality of valves into the valve sleeve against a biasing force of the valve spring. The cam flank is designed to permit the valve spring of a respective one of the plurality of valves to axially displace the valve cylinder partially out of the valve sleeve to unblock the ports in the valve sleeve.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
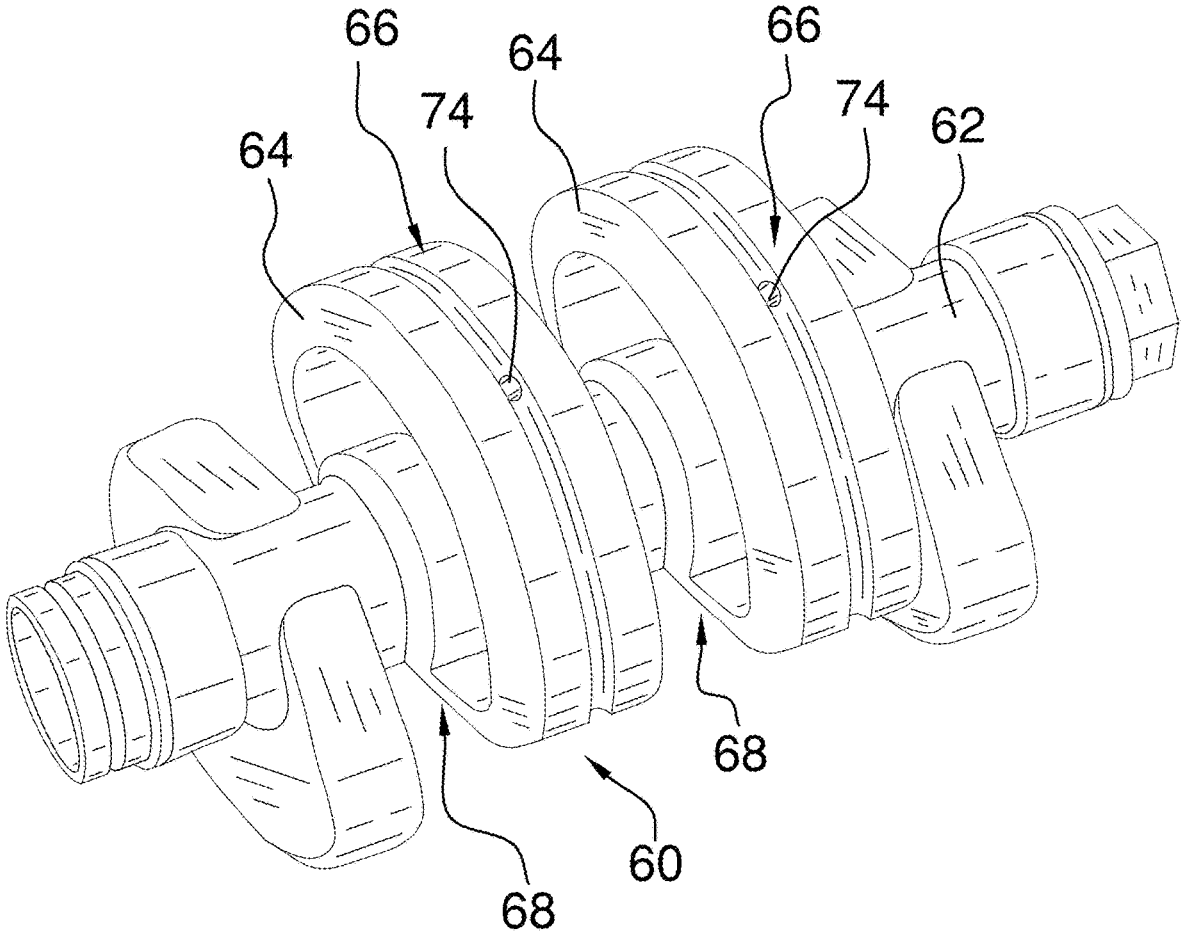
FIG. 1 is a view of a camshaft according to an embodiment of the disclosure.

With reference now to the drawings, and in particular to FIGS. 1 through 5 thereof, a new valve embodying the principles and concepts of an embodiment of the disclosure and generally designated by the reference numeral 10 will be described.

Figure 3:
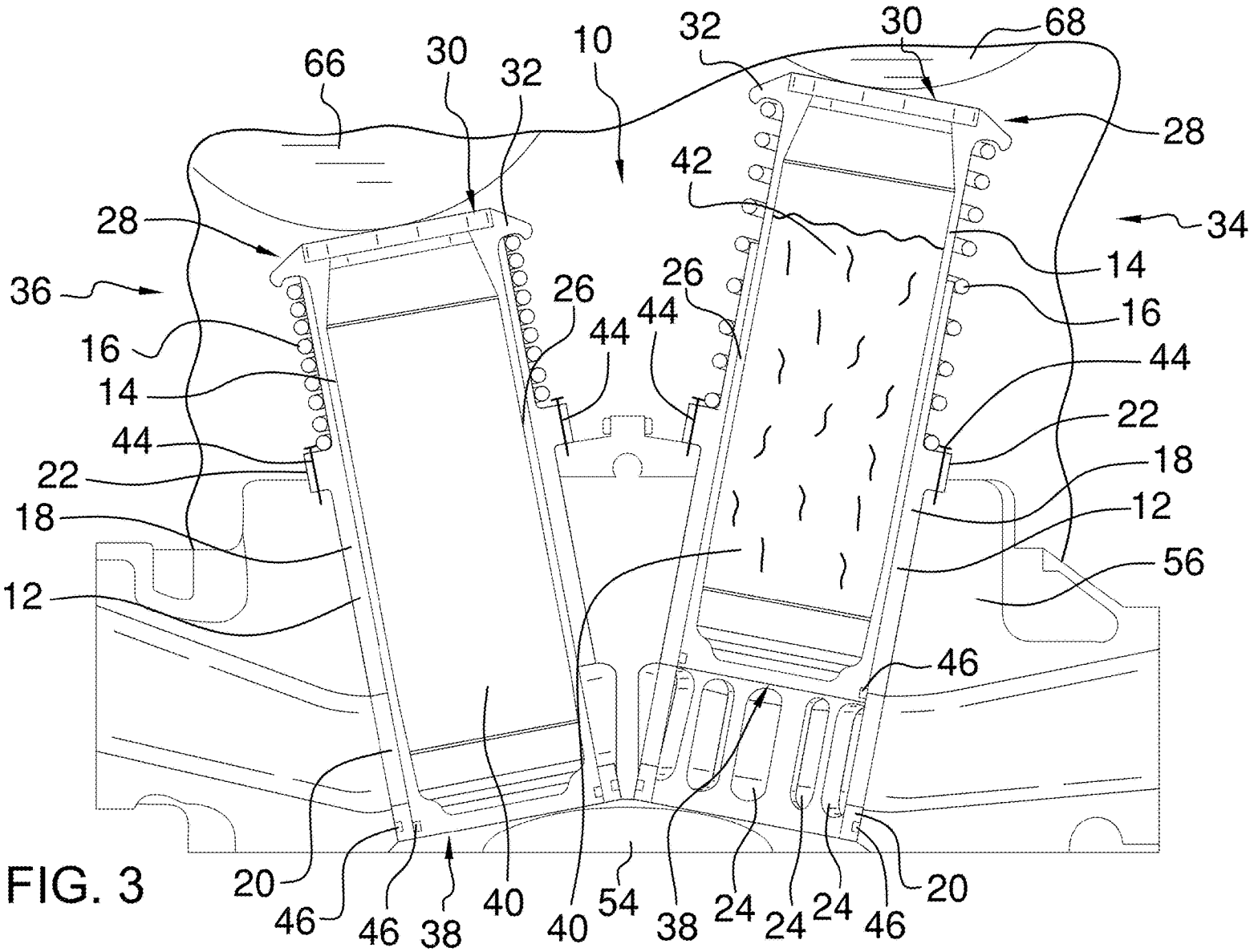
FIG. 3 is a side view of a valve according to an embodiment of the disclosure.

As best illustrated in FIG. 3, the valve 10 generally comprises a valve sleeve 12, a valve cylinder 14, and a valve spring 16. The valve sleeve 12 is cylindrical. The valve sleeve 12 includes a top portion 18 and a bottom portion 20. The top portion 18 includes an annular shoulder 22. The bottom portion 20 includes ports 24 designed to permit flow of fuel and gases into and out of an internal combustion chamber 54 through the valve sleeve 12. The valve cylinder 14 is positioned in the valve sleeve 12. The valve cylinder 14 includes a cylindrical body 26 and a top cap 28. The top cap 28 includes a contact surface 30 that is designed to be engaged by a cam lobe 64. The top cap 28 includes an annular projection 32 extending outwardly beyond an outer surface of the cylindrical body 26. The valve spring 16 is positioned about the cylindrical body 26 of the valve cylinder 14. The valve spring 16 is positioned between the annular projection 32 of the valve cylinder 14 and the annular shoulder 22 of the valve sleeve 12. The valve spring 16 is designed to expand and move the valve cylinder 14 partially out of the valve sleeve 12 to unblock the ports 24 and open the valve 10, which is marked in FIG. 3 as the open position 34. The valve spring 16 is designed to be compressed to permit the cam lobe 64 to move the valve cylinder 14 into the valve sleeve 12 to block the ports 24 and close the valve 10, which is marked in FIG. 3 as the closed position 36.

An example of the design of the ports 24 is shown in FIG. 3, wherein the ports 24 are elongated slots with rounded ends. However, this is merely an exemplary embodiment as the ports 24 could be designed with different sizes and cross-sectional designs as desired to produce different types or characteristics of engine performance. Other components of the valve 10 are also adjustable, such as length and diameter of the valve cylinders 14 and valve sleeves 12, stroke length, and size and characteristics of the valve spring 16. All of the components of the valve 10 can be scaled and re-sized as desired to achieve different engine performance characteristics. For example, the valve cylinder 14 can have a diameter in the range of 25 mm to 50 mm, or possibly more, depending on the engine design. The stroke length or lift, as measured by how far the valve cylinder 14 projects out of the valve sleeve 12, could be in the range of 10 mm to 25 mm, or possibly more, also depending on the engine design.

The valve spring 16 is designed to restrict the movement of the valve cylinder 14 into the valve sleeve 12 to prevent the valve cylinder 14 from projecting out of the bottom portion 20 of the valve sleeve 12 and into the internal combustion chamber 54 when the valve 10 is closed. As can be seen in the exemplary embodiment in FIG. 3, when the valve 10 is in the closed position 36, a bottom surface 38 of the valve cylinder 14 is flush with the bottom portion 20 of the valve sleeve 12 to achieve complete closing of the valve 10 without projecting into the combustion chamber 54.

In the exemplary embodiment, the valve cylinder 14 includes an internal chamber 40 positioned within the cylindrical body 26. The valve cylinder 14 therefore can have an essentially hollow design to reduce weight and material costs, though the valve cylinder 14 could be solid. In one possible embodiment, the valve 10 further includes coolant material 42 positioned in the internal chamber 40 to absorb heat. Such coolant material 42 could be salts, though other coolant material 42 is within the scope of the disclosure. The coolant material 42 is shown in only one of the cylinders in FIG. 3, though both could include coolant material 42.

In the exemplary embodiment shown in FIG. 3, the valve 10 further includes locking structures 44 designed to detachably connect the valve sleeve 12 to a frame 56 of an internal combustion engine. In one possible embodiment, the locking structures 44 are designed to detachably connect the annular shoulder 22 of the valve sleeve 12 to the frame 56 of the internal combustion engine. FIG. 3 shows an example in which a schematic representation of the locking structure 44, such as a screw or bolt, is inserted into the annular shoulder 22 to removably attach the valve sleeve 12 to the frame 56. Such a design can facilitate easier repair and maintenance as the entire valve 10 can be easily removed as a single unit without having to remove a cylinder head from a cylinder block as is presently required in current overhead cam engines.

The valve cylinder 14 and the valve sleeve 12 can include sealing rings 46 or gaskets to ensure a tight seal. Lubricant can be passed in a known manner between the valve cylinder 14 and the valve sleeve 12 to ensure smooth movement.

Figure 2:
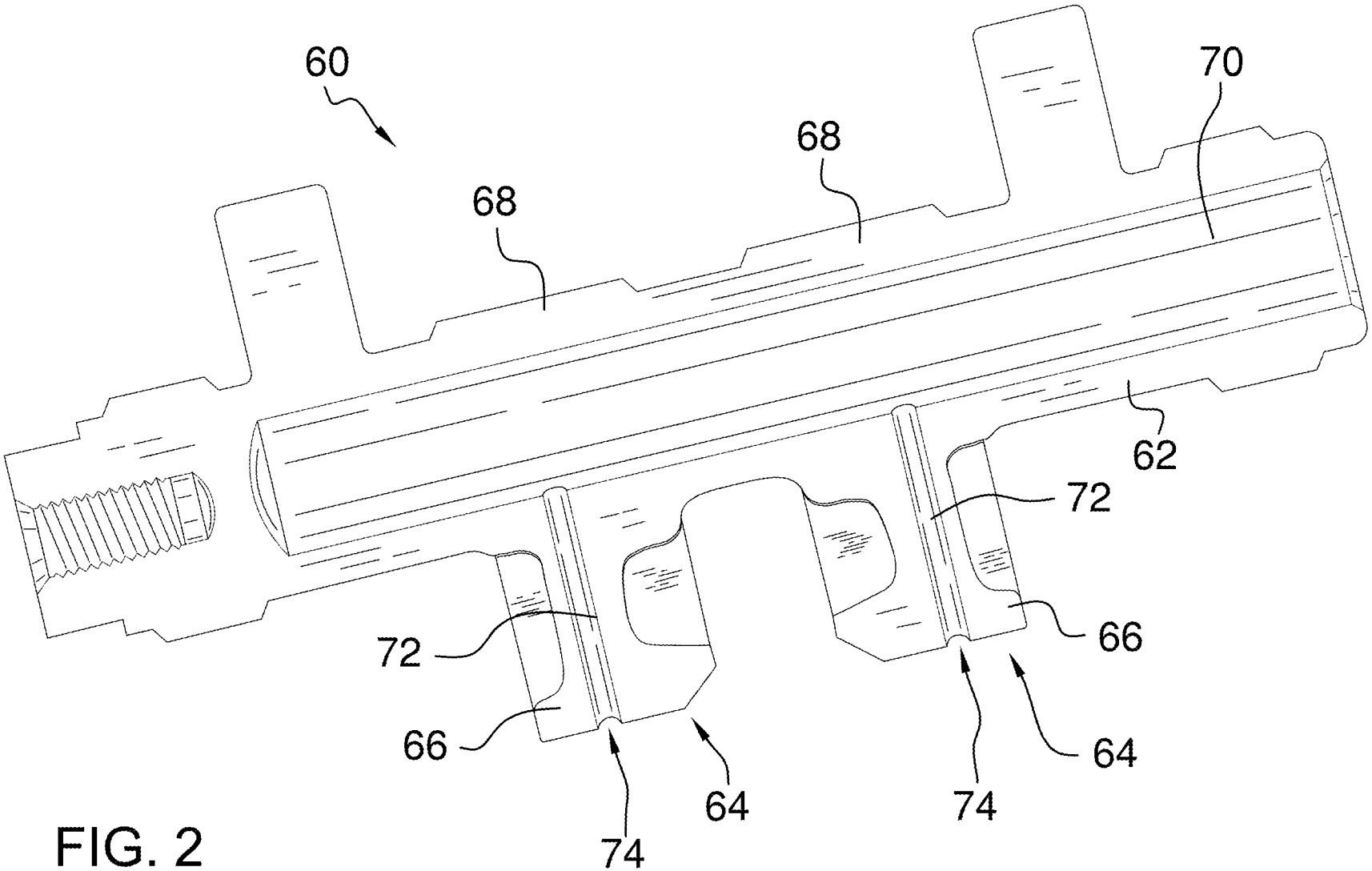
FIG. 2 is a cross-sectional view of the camshaft of FIG. 1.
Figure 4:
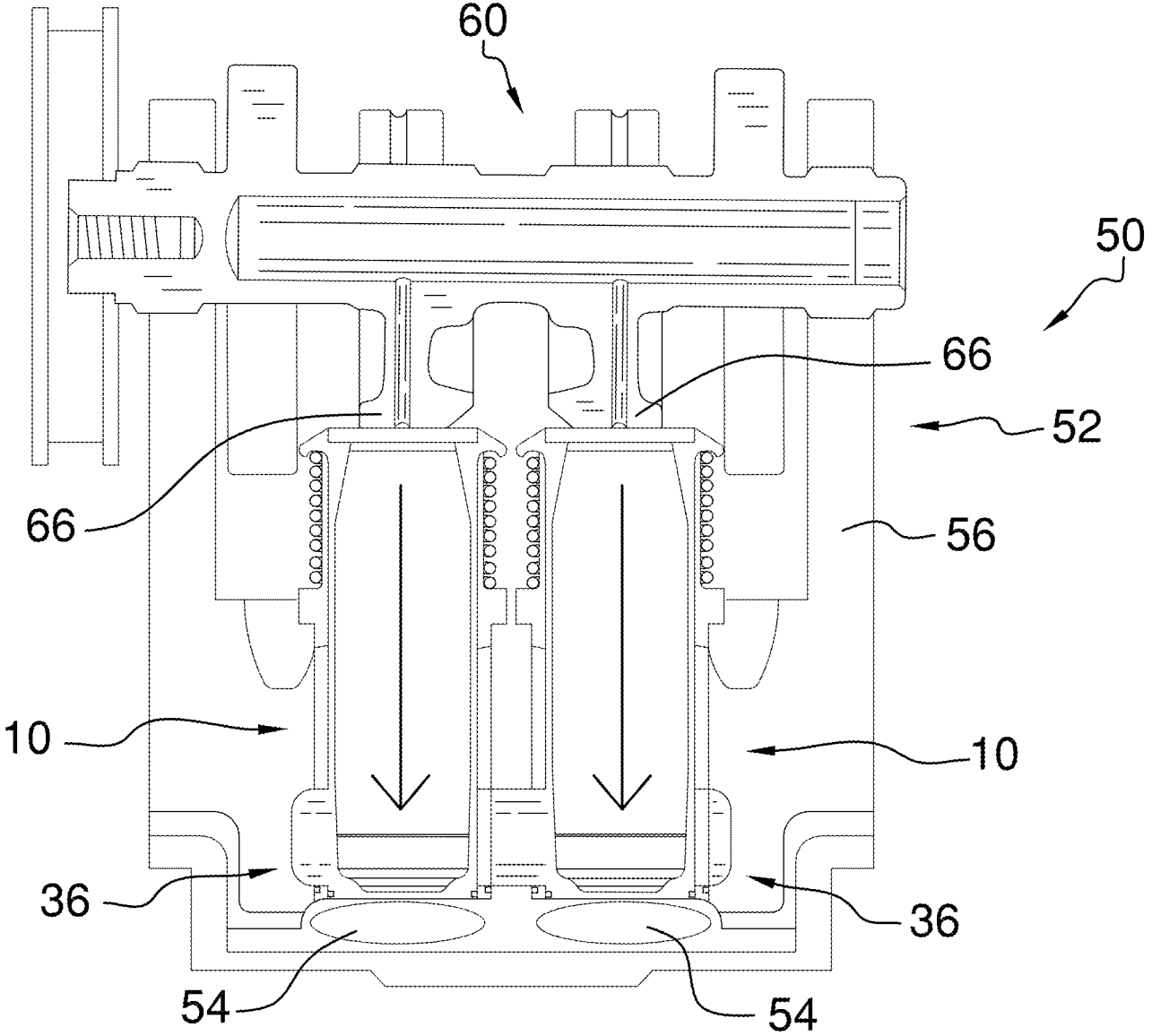
FIG. 4 is a side cross-sectional view of an overhead cam engine assembly according to an embodiment of the disclosure.
Figure 5:
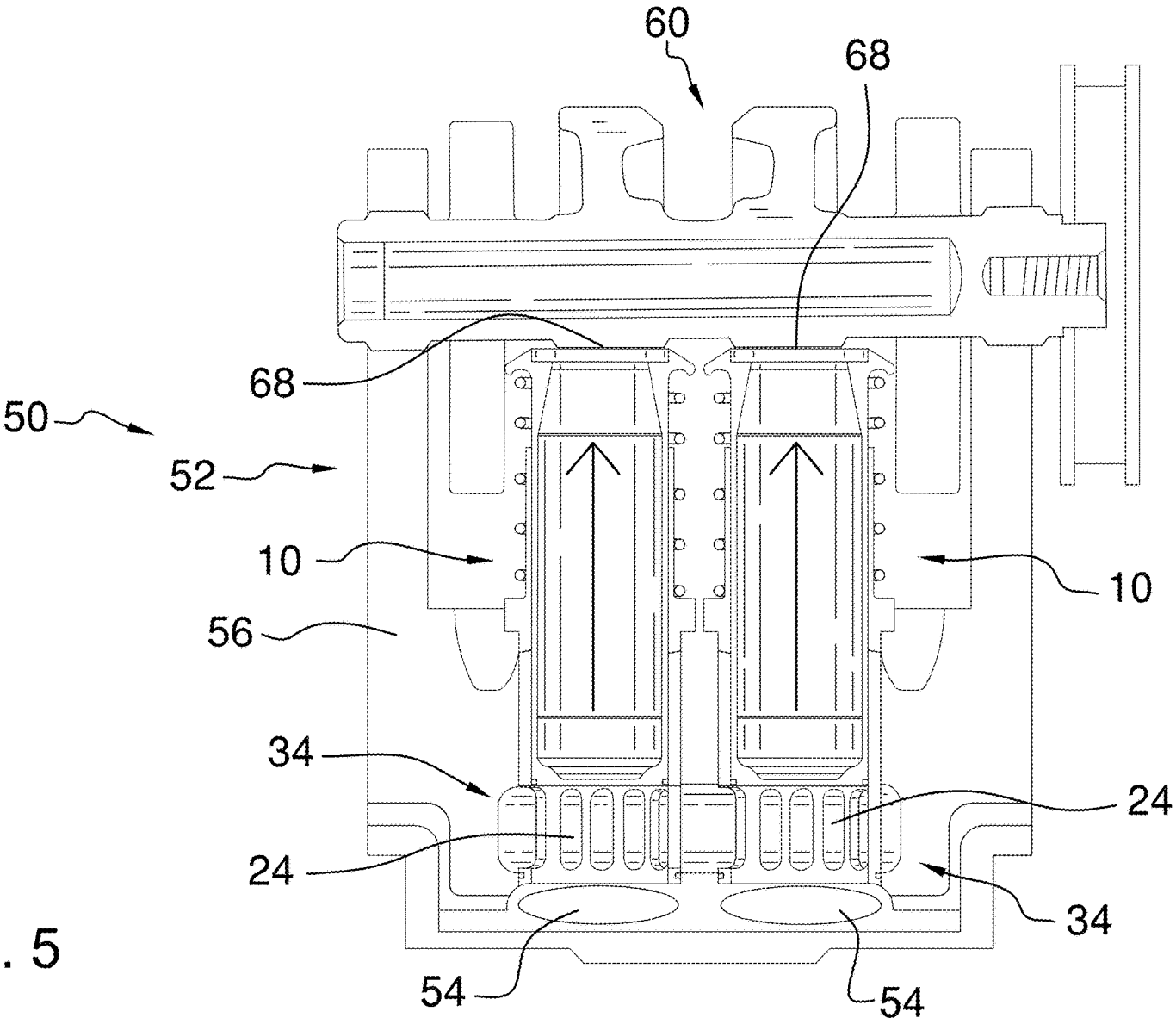
FIG. 5 is a side cross-sectional view of the overhead cam engine assembly of FIG. 4.

The valve 10 is used in an overhead cam engine assembly 50, which can be specifically designed to interact with and accommodate the valve 10. An exemplary embodiment is shown in FIGS. 4 and 5 and will be discussed further below. A plurality of the valves 10 is mounted in an internal combustion engine 52. With reference to FIGS. 1 and 2, a camshaft 60 is designed to be rotatably mounted in the internal combustion engine 52. The camshaft 60 includes a shaft portion 62 and a plurality of cam lobes 64 projecting from the shaft portion 62. Each of the cam lobes 64 is designed to continuously contact the contact surface 30 of the valve cylinder 14 of a respective one of the plurality of valves 10. Each of the cam lobes 64 includes a cam nose 66 and a cam flank 68. The cam nose 66 is designed to axially displace the valve cylinder 14 of a respective one of the plurality of valves 10 into the valve sleeve 12 against a biasing force of the valve spring 16. The cam flank 68 is designed to permit the valve spring 16 of a respective one of the plurality of valves 10 to axially displace the valve cylinder 14 partially out of the valve sleeve 12 to unblock the ports 24 in the valve sleeve 12.

In the exemplary embodiment shown in FIGS. 1 and 2, the shaft portion 62 of the camshaft 60 includes an internal lubricant reservoir 70. Each of the cam lobes 64 includes an internal channel 72 having an exit orifice 74 positioned in an outer surface of the cam lobe 64. The internal channel 72 of each of the cam lobes 64 is connected to the internal lubricant reservoir 70 of the shaft portion 62 to permit flow of lubricant to the outer surface of each of the cam lobes 64 and the contact surface 30 of each of the valve cylinders 14. Since the cam lobe 64 is in constant contact with the contact surface 30, the lubrication is important to minimize friction and resulting wear. Other designs and methods of lubrication common to engine technology are within the scope of the disclosure.

FIGS. 4 and 5 show the operating principles of the valve 10 and the related overhead cam engine assembly 50. The operation of the camshaft 60 and the combustion chamber 54 is the same as for most any overhead cam system. The operation of the valves 10 though is much different. As shown in FIG. 4, the camshaft 60 is rotated such that the cam nose 66 of each cam lobe 64 engages the contact surface 30 of the respective valve cylinder 14. The engaging force of the cam lobe 64 overcomes the expansion force of the valve spring 16, thereby compressing the valve spring 16 and pushing the valve cylinder 14 fully into the valve sleeve 12. The cam lobes 64, the valve spring 16, and the valve cylinder 14 are sized such that the valve cylinder 14 cannot be pushed into the combustion chamber 54. As shown in FIG. 5, the camshaft 60 is rotated such that the cam flank 68 of each cam lobe 64 engages the contact surface 30 of the respective valve cylinder 14. Since the cam flank 68 does not project radially as far as the cam nose 66 does, the valve spring 16 is permitted to expand and move the valve cylinder 14 partially out of the valve sleeve 12, thereby unblocking the ports 24. It should be noted that the cam lobe 64 is never out of engagement with the contact surface 30 of the respective valve cylinder 14. Current overhead cam engine designs utilize a valve 10 lash, which is a calibrated space between the contact surface 30 of the poppet valve 10 and the cam lobe 64. Valve lashes are notoriously difficult to set due to tight tolerances and extremely small adjustment measurements, which are easily affected by wear and tear. The valve 10 disclosed herein eliminates the valve 10 lash and ensures stable control over the valve cylinder 14 by the very robust and durable cam lobe 64.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A valve for an overhead cam engine, the valve comprising:

a cylindrical valve sleeve including:

a top portion defining an annular shoulder, and a bottom portion defining a plurality of ports configured to convey a flow of fuel and gases into or out of an internal combustion chamber of the engine;

a valve cylinder disposed in said valve sleeve, said valve cylinder including a cylindrical body and a top cap, said top cap defining:

a contact surface configured to be engaged by a cam lobe, and an annular projection extending radially outwardly of said cylindrical body; and a valve spring disposed about said cylindrical body so as to be pressed between said annular projection of said valve cylinder and said annular shoulder of said valve sleeve, said valve spring configured to:

bias said valve cylinder partially out of said valve sleeve so as to unblock said plurality of ports and open the valve, and compress as the cam lobe moves said valve cylinder into said valve sleeve so as to block said plurality of ports and close the valve.

2. The valve of claim 1, wherein said valve spring is further configured to limit a stroke of said valve cylinder into said valve sleeve so as to prevent said valve cylinder from projecting into the internal combustion chamber when the valve is closed.

3. The valve of claim 1, wherein said cylindrical body defines an internal chamber.

4. The valve of claim 3, wherein a coolant material is disposed in said internal chamber so as to absorb heat.

5. The valve of claim 1, wherein said valve sleeve is detachably connected to a frame of the engine via a plurality of locking structures.

6. The valve of claim 5, wherein said plurality of locking structures is configured to engage said annular shoulder so as to detachably connect said valve sleeve to the frame.

7. The valve of claim 2, wherein:

said cylindrical body defines an internal chamber;

a coolant material is disposed in said internal chamber so as to absorb heat; and said annular shoulder of said valve sleeve is detachably connected to a frame of the engine via a plurality of locking structures.

8. An overhead cam engine assembly comprising:

an internal combustion engine;

a plurality of valves configured to be mounted in the engine, each valve including:

a cylindrical valve sleeve including:

a top portion defining an annular shoulder, and a bottom portion defining a plurality of ports configured to convey a flow of fuel and gases into or out of an internal combustion chamber of the engine, a valve cylinder disposed in said valve sleeve, said valve cylinder including a cylindrical body and a top cap, said top cap defining:

a contact surface, and an annular projection extending radially outwardly of said cylindrical body, and a valve spring disposed about said cylindrical body so as to be pressed between said annular projection of said valve cylinder and said annular shoulder of said valve sleeve, said valve spring configured to:

bias said valve cylinder partially out of said valve sleeve so as to unblock said plurality of ports and open the valve, and compress as said valve cylinder is axially displaced into said valve sleeve so as to block said plurality of ports and close the valve; and a camshaft configured to be rotatably mounted in the engine, said camshaft including a shaft portion and a plurality of cam lobes projecting from said shaft portion, each cam lobe configured to continuously engage said contact surface of a respective valve of said plurality of valves, each cam lobe including:

a cam nose configured to axially displace said valve cylinder into said valve sleeve against a biasing force of said valve spring so as to block said plurality of ports of the respective valve, and a cam flank configured to enable said valve spring to axially displace said valve cylinder partially out of said valve sleeve so as to unblock said plurality of ports of the respective valve.

9. The overhead cam engine assembly of claim 8, wherein:

said shaft portion defines an internal lubricant reservoir;

each cam lobe defines an internal channel with an exit orifice disposed at an outer surface of said cam lobe; and said internal channel of each cam lobe is connected to said internal lubricant reservoir so as to enable a flow of lubricant to said outer surface of said cam lobe and said contact surface of the respective valve.

10. The overhead cam engine assembly of claim 9, wherein in each valve, said valve spring is configured to limit a stroke of said valve cylinder into said valve sleeve so as to prevent said valve cylinder from projecting into the internal combustion chamber when the valve is closed.

11. The overhead cam engine assembly of claim 9, wherein in each valve, said cylindrical body defines an internal chamber.

12. The overhead cam engine assembly of claim 11, wherein a coolant material is disposed in said internal chamber of each valve so as to absorb heat.

13. The overhead cam engine assembly of claim 9, wherein in each valve, said valve sleeve is detachably connected to a frame of the engine via a plurality of locking structures.

14. The overhead cam engine assembly of claim 13, wherein in each valve, said plurality of locking structures is configured to engage said annular shoulder so as to detachably connect said valve sleeve to the frame.

15. The overhead cam engine assembly of claim 10, wherein in each valve:

said cylindrical body defines an internal chamber;

a coolant material is disposed in said internal chamber so as to absorb heat; and said annular shoulder of said valve sleeve is detachably connected to a frame of the engine via a plurality of locking structures.

* * * * *